United States Patent [19]

Anagnostopoulos

[11] 4,273,454

[45] Jun. 16, 1981

[54] TAPE TENSIONING MECHANISM

[75] Inventor: Stavros M. Anagnostopoulos, Lansdowne, Pa.

[73] Assignee: Exxon Research & Engineering Co., Florham Park, N.J.

[21] Appl. No.: 48,906

[22] Filed: Jun. 15, 1979

[51] Int. Cl.[3] ..... B41J 33/14

[52] U.S. Cl. ..... 400/234; 400/208; 400/242; 400/248; 400/696

[58] Field of Search ..... 400/208, 234, 242, 248, 400/696, 697, 697.1; 242/75.4, 75.43, 156; 226/195

[56] References Cited

U.S. PATENT DOCUMENTS

| | | | |
|---|---|---|---|
| 2,202,958 | 6/1940 | McFarland | 400/234 X |
| 3,022,958 | 2/1962 | Bieber | 400/242 X |
| 3,323,743 | 6/1967 | Landgraf | 400/242 X |
| 3,349,887 | 10/1967 | Goff, Jr. | 400/208 |
| 3,409,114 | 11/1968 | Okuda | 400/242 X |
| 3,724,633 | 4/1973 | Korb et al. | 400/248 X |
| 3,788,442 | 1/1974 | Lehnhardt et al. | 400/696 |
| 3,998,314 | 12/1976 | Barouh et al. | 400/696 |

FOREIGN PATENT DOCUMENTS

| | | | |
|---|---|---|---|
| 2452103 | 5/1976 | Fed. Rep. of Germany | 400/234 |
| 2542259 | 12/1976 | Fed. Rep. of Germany | 400/234 |
| 2547957 | 5/1977 | Fed. Rep. of Germany | 400/697.1 |

OTHER PUBLICATIONS

Xerox Disclosure Journal, "Ribbon Advance Mechanism", Mikes, vol. 2, No. 4, Jul./Aug., 1977, p. 47.

*Primary Examiner*—Ernest T. Wright, Jr.
*Attorney, Agent, or Firm*—Norman L. Norris

[57] ABSTRACT

An improved ribbon tensioning means is disclosed in which a spring-loaded gear rack is in engagement with a gear wheel formed on a spool of tape to be unwound. The gear rack is provided with sufficient travel in the direction opposite to that of the spring force that the teeth thereon can be disengaged from those on the gear wheel if the wheel is rotated a sufficient distance, thus constantly providing tension to a tape or ribbon wound on the spool.

9 Claims, 4 Drawing Figures

TAPE TENSIONING MECHANISM

FIELD OF THE INVENTION

The present invention relates to the field of tape tensioning devices. More particularly, the invention comprises a tape tensioning device specifically designed for applying a continuous tension to the erase tape of a typewriter with erase tape availability.

BACKGROUND OF THE INVENTION

For many years the practice in correcting errors made by a typist was to either use a gum eraser to abrade away the ink on the paper or to paint over the error with a paint colored to match the color of the paper. More recently there have been developed two types of erase tapes which are struck with the letter in error and "erase" it. One is a cover-up tape in which a second ink, color to match the color of the paper, is printed over the contrasting color typing ink (which will be known hereafter as an overprint erase tape); a second type is a tape in which the ink is actually lifted off the paper and carried off by the erase tape. With this type (which will be known hereafter as a liftoff type of erase tape) special liftoff inks must be used.

Both the liftoff and the overprint type of erase tapes, however, have certain things in common. One is that each is only useful a single time per unit spacing, that is, the tape can only be used to erase one letter and then a new section of tape must be supplied to correct the next error. For this reason, the tapes are usually supplied on single reels which are threaded past the typing head and interposed between the characters striking the inked ribbon and the paper. They are wound a single space ahead at a time, and are discarded when they have been wound all the way from one end to the other.

Clearly, under these circumstances, it is essential that the gradually unwinding spool of tape be kept under tension so that the tape does not belly or sag into the remainder of the typing machinery. For this reason it is essential to apply a continuous tensioning force to the tape. The tensioning devices available in the prior art have not adequately performed their function. Therefore, until the present invention, it had been a need of the art to provide an improved tensioning device.

OBJECTS OF THE INVENTION

It is therefore an object of the invention to provide an improved tape tensioning device.

It is a further object of the invention to provide a tape tensioning device which is simple and economical of manufacture.

It is still a further object of the invention to provide a tape tensioning device which provides a constant tension to the tape.

It is still a further object of the invention to provide a tape tensioning device which allows easy mounting and demounting of fresh spools of erase tape thereon by an operator.

SUMMARY OF THE INVENTION

The above objects of the invention and needs of the art are fulfilled by the present invention which comprises a capstan for mounting of a reel of erase tape having a gear, preferably integrally formed therewith, which engages at least one tooth of a rack which is spring biased in a direction opposing the direction of rotation of a capstan, but which is provided with sufficient travel in the opposite direction that the rack teeth can be disengaged from the gear by rotation of the capstan, thus permitting it to rotate in one direction only.

BRIEF DESCRIPTION OF THE DRAWING

The invention will be better understood if reference is made to the accompanying drawing in which.

DESCRIPTION OF THE PREFERRED EMBODIMENTS

Figure 1:
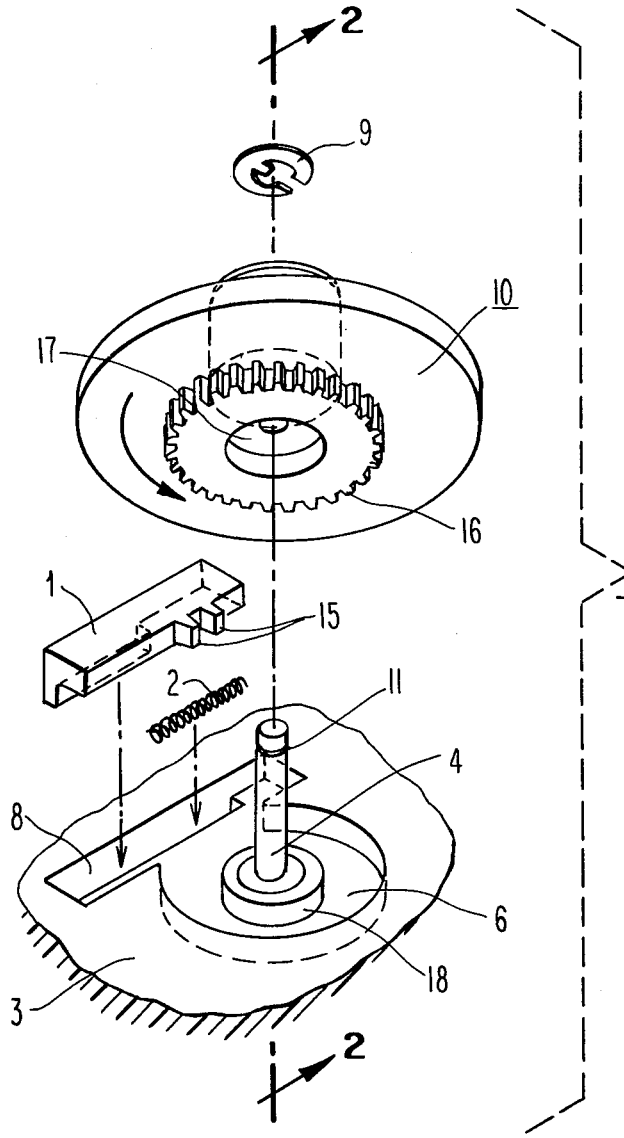
FIG. 1 represents an exploded view of the tape tensioning mechanism of the invention.

Referring now to FIG. 1, an exploded view of the tape tensioning mechanism of the invention is shown. In this figure, the mechanism of the invention is shown as mounted on a plate 3 shown merely as an area of undefined extent; in FIG. 4, the inventive mechanism is shown in a typewriter, which may preferably be as disclosed in copendng application Ser. No. 833,352 to Hatsell, filed Sept. 14, 1977, now U.S. Pat. No. 4,203,776, issued May 20, 1980, and assigned to the assignee of the present invention and incorporated herein by reference. For present purposes, it is sufficient to consider that the tape tensioning mechanism of the invention is attached in an operative relationship with the remainder of a typewriter such that the erase tape wound on the capstan is available for its intended purpose.

Figure 3:
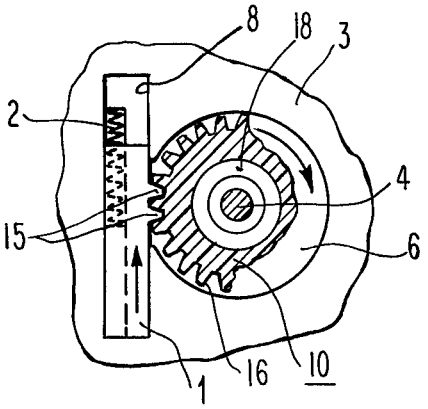
FIG. 3 represents a second cross-sectional view of the mechanism of the invention.

As discussed above, the tape tensioning device of the invention comprises a capstan 10 having formed thereon or attached thereto a gear 16 which engages teeth 15 on a pawl or slider 1. The slider 1 slides within a recess 8 and is biased by a spring 2 in a direction so as to oppose the rotation of the capstan 10 in the direction indicated by the arrow drawn thereon. The slider 1 is permitted sufficient travel in the opposite direction that teeth 15 can become disengaged from gear 16, thus permitting the capstan 10 to make a rotation. This will be more clear if reference is made to FIG. 3, which shows an assembled plan view of the mechanism of the invention. There it is seen how if gear 16 is rotated in the direction of the arrow by, for example, pulling on and unwinding a tape 42 (FIG. 4) wrapped around the capstan 10, slider 1 moves in (with reference in FIG. 3) the "up" direction against the opposition of the spring 2, the slider 1 being shown in its rest position, that is, biased by spring 2 against the "lower" wall of recess 8, thus preventing rotation of capstan 10 in the direction opposite to the arrow shown thereon. If the capstan 10 is rotated by pulling erase tape 42 off a reel or spool 38 (FIG. 4) mounted thereon and if the slider 1 is moved up far enough by the action of the gear 16, the teeth 15 on the slider 1 will become disengaged from the gear 16, thus enabling the capstan 10 to be rotated without moving the slider 1 any further. It will be apparent that the motion of the capstan 10 will usually be of a stepwise or ratcheting type, and that the length of the steps is dependent on the number of teeth 15 on the slider 1, and the pitch (i.e. spacing) thereof.

Figure 2:
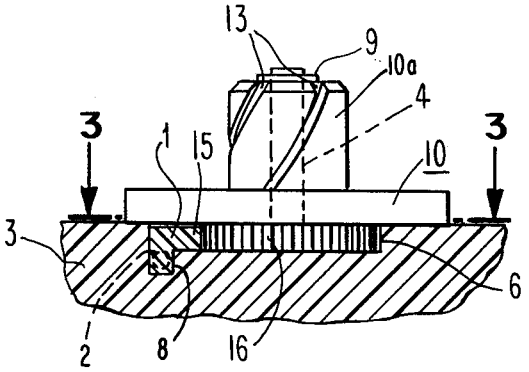
FIG. 2 represents a cross-sectional view of the tape tensioning mechanism of the invention when assembled.

As shown in FIGS. 1 and 2, the capstan 10 is desirably retained on a post 4 by means of a clip 9 fitting into a groove 11. The capstan 10 may also be provided with a recess 17 which may engage a raised area 18 for further refinement of its fit. As shown in FIG. 2, the shaft 10*a* of the capstan 10 may be provided with helical keyways 13. The spool 38 (FIG. 4) on which the erase tape 42 is mounted is desirably provided with corresponding pegs which can slide within helical keyways 13. The fact that the keyways 13 are helical means that the tape spool 38 (FIG. 4) will tend to stay on the capstan 10 by means of the action of the tension on the tape 42 pulling the spool 38 (FIG. 4) down towards the bottom of the keyways 13.

As shown perhaps most clearly in FIG. 2, it is desirable that the slider 1, spring 2, and gear 16 be arranged in recesses 8 and 6, respectively, formed within the plate 3 so that the flange of the capstan 10 may enclose these parts and so that they are not provided an opportunity to escape from their proper arrangement.

The tensioning mechanism of the invention can be readily assembled. Typically, the assembly steps are as follows: spring 2 is dropped into recess 8, and is compressed against the end thereof while slider 1 is inserted. The capstan 10 is then slid onto post 4, such that the gear wheel 16 engages the slider teeth 15, and clip 9 is snapped into groove 11, retaining capstan 10 on post 4 and completing assembly.

Figure 4:
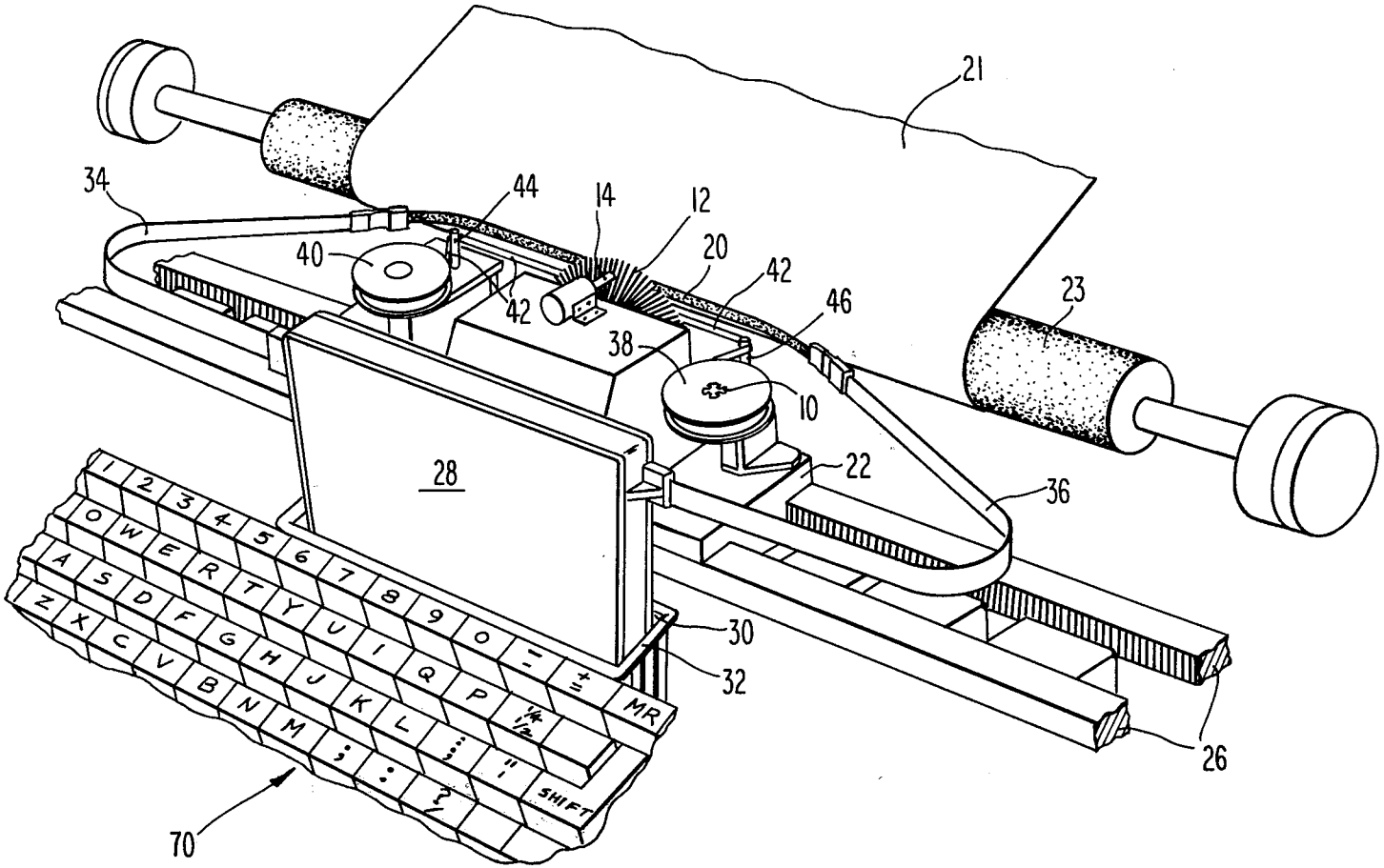
FIG. 4 shows a perspective view of the mechanism of the invention in its intended environment, i.e. a typewriter.

Referring now to FIG. 4, the tape tensioning mechanism of the invention is shown in the total environment, that is, in a typewriter. In FIG. 4, one sees in perspective certain of the important operating mechanisms of a typewriter, including a keyboard 70 having a multiplicity of keys corresponding to the various characters of the alphabet which upon depression control the position of the rotatable character array in the form of a print wheel or daisy 12 juxtaposed between impact means in the form of a hammer 14 and a platen 23. The platen 23 is adapted to support a print receiving medium 21, ordinarily paper, which is contacted by the marking medium in the form of a print ribbon or inked ribbon 20, which is located between the print wheel 12 and the paper 21, so as to leave a marking corresponding to the particular character of the print wheel 12 which is in position between the hammer 14 and the paper 21.

As shown in FIG. 4, the print wheel 12 and the hammer 14 are mounted on a carriage 22 which is adapted to move in a lateral direction parallel to the surface of the platen 23 so as to position the print wheel 12 at various positions along the paper 21 in response to the depression of keys on the keyboard 70. As the carriage 22 is moved, the print wheel 12 rotates so as to position the proper character element at the end of a radially extending spoke in a printing position aligned with the print hammer 14. The lateral movement of the carriage 22 along the support surfaces 26 may be achieved by various means known in the art, including a linear stepper motor.

In accordance with copending application Ser. No. 833,270, filed Sept. 14, 1977, in the name of Matthias and assigned to the assignee of the present invention, the print ribbon 20 is desirably stored within the housing of a stationary cartridge 28 which is received by a pocket 30 in an integrally molded receptacle 32. As shown in FIG. 4, the ribbon path length between the print point and the cartridge 28 is determined by the position of the carriage 22, and is maintained constant over a substantial portion thereof by a first flexible leader 34 which extends from the cartridge 28 to the carriage 22 and a second flexible leader 36 which extends from the carriage 22 back to the cartridge 28.

Between the first flexible leader 34 and second flexible leader 36, a segment of the ribbon 20 is exposed and this segment is to be positioned adjacent the print point. As more clearly pointed out in copending application Ser. No. 833,269, filed Sept. 14, 1977, in the name of Miller et al, now abandoned, also assigned to the assignee of the present invention, situated within the cartridge 28 is a supply reel and take-up reel (not shown) upon which the print ribbon 20 is wound. Further, a drive means, not shown, is associated with the supply reel and the take-up reel so as to continuously supply a fresh segment of ribbon 20 to the print point.

In addition to the hammer 14, the carriage 22 also supports and transports an erase ribbon supply reel 38, guide posts 44 and 46, and erase ribbon take-up reel 40. The present invention comprises the structure upon which the erase ribbon supply reel 38 is mounted. Wound around the erase ribbon supply reel 38 and positioned adjacent but below the moving print point is an erase ribbon or tape 42 which may be of either the lift-off or the overprint types discussed above, and may be used to remove characters which have been formed on the paper 21 by the print ribbon 20.

Also supported on and transported by the carriage 22 is a mechanism for lifting the print ribbon 20 and the erase ribbon or tape 42 from their rest positions below the print point to their operating positions at the print point. Ribbons 20 and 42 are raised and lowered in order that the operator of the printer is able to observe each printed character after it has been formed on the print receiving medium 21. Print ribbon 20 is elevated to its operating position when a key of keyboard 70 is depressed. However, the erase ribbon or tape 42 is elevated to its operating position only when the printer is operating in an erase mode. At all other times, both print ribbon 20 and erase ribbon or tape 42 are maintained in their positions below the print point. The particular lifting mechanisms for both of these ribbons 20 and 42 are the subject of copending application Ser. No. 833,272, filed Sept. 14, 1977, in the name of Hatsell, now U.S. Pat. No. 4,203,677, issued May 20, 1980, and assigned to the assignee of the present invention.

The operation of the tape tensioning mechanism of the invention in the typewriter context will be apparent; it supports erase ribbon supply reel 38 and maintains tension on erase ribbon or tape 42 while it is being pulled over onto take-up reel 40 by powering means (not shown) during operation of the typewriter in the erase mode. In this way, the ribbon 42 is made available for overstrike correction of errors while being prevented from sagging into and obstructing other parts of the typewriting machinery. Further, it will be apparent that the tension exerted on the erase ribbon or tape 42 by the tape tensioning means of the invention is governed only by the amount of compression of the spring 2 within its recess 8 by the slider 1. Prior to the present invention, tension on the erase tape 42 had to be adjusted by various means, none of which were satisfactory. With the present invention, once the design has been settled upon, the parts need merely be assembled and no adjustment or "tweaking" is required.

It will be appreciated by those skilled in the art that the tape tensioning device described herein exerts a constant tension on the tape 42. That is to say, there is no point in the motion of the capstan 10 at which no tension is being exerted; there is no rest position. Moreover, it will be appreciated that the mechanism provided is at once simple and easy to manufacture yet practically foolproof and admirably capable of performing its desired function. Further, it will be appreciated that the provision of the helical keyways 13 provides a means for mounting a spool 38 of tape 42 on the capstan 10 which, although it provides for ready removal without tools and without threads, nuts, bolts or other additional parts, nevertheless provides a firm nonslip mounting means. The erase tape 42 can be supplied on a simple supply reel 38, which might become a take-up reel 40 when emptied of tape 42, the tape 42 being threaded around guide posts 44 and 46 and onto the take-up reel 40 by the operator, or might be supplied prethreaded onto a new take-up reel 40. Finally, it will be appreciated by those skilled in the art that there are numerous modifications and improvements which can be made to the invention as disclosed without departing from its essential scope. Therefore, the description of the preferred embodiments given above should not be taken as limiting its scope but as exemplary only; the scope of the invention is more properly defined by the following claims.

I claim:

1. A tape tensioning device comprising:

a capstan, comprising means for securing a spool of tape thereto, a toothed gear wheel and a flange of greater diameter than said wheel;

a slider provided with at least one tooth sized to be engaged with said toothed gear wheel; and a spring;

said slider being biased in one direction by said spring and sliding within a recess so sized that said slider can be advanced, in the opposite direction only, a distance sufficient that the teeth thereon are permitted to slip with respect to those on said toothed gear wheel, said recess being enclosed by said flange so that escape of said slider and said spring is prevented.

2. The device of claim 1 wherein said spool securing means comprises at least one helical keyway for mating with said spool of tape.

3. In a typewriter of the type comprising a typing error erase tape supplied on a spool, the improvement comprising:

mounting said spool in a capstan comprising a toothed gear wheel and a flange, the teeth of said wheel engaging at least one tooth on a slider sliding within a recess, said slider being spring-biased in a given direction by a spring acting on a wall of said recess, being mounted to slide in the opposite direction a distance sufficient to disengage the gear wheel from the teeth on the slider, and being confined to said recess by said flange.

4. A method of assembing a tape tensioning mechanism, comprising the steps of:

providing a mounting structure having a longitudinally extending recess formed therein, and comprising a cylindrical shaft;

providing a slider, shaped to slide within said recess, and having one or more teeth thereon;

inserting a compression spring into said recess, and inserting said slider into said recess as well such that the spring biases the slider in one direction lengthwise along the recess;

mounting a capstan comprising a gear wheel having a diameter and tooth spacing so as to mesh with the teeth on said slider and a flange greater in diameter than said gear wheel on said shaft; and providing retention means to retain said capstan on said shaft; whereby escape of said slider and said spring from said recess is precluded by said flange.

5. The method according to claim 4, wherein said retention means comprises a groove formed on said shaft and a spring clip sized to fit therein.

6. The method according to claim 4, wherein the gear wheel fits within a circular recess formed in said mounting structure, and wherein said longitudinally extending recess is formed such that said longitudinally extending recess and said circular recess are in communication along a line, parallel to the line of said longitudinal extension, and long enough to permit sufficient motion of the teeth on said slider therein to allow stepwise motion of said gear wheel.

7. Method of maintaining tension on an erase tape, comprising:

mounting a spool of said tape on a capstan, said capstan comprising a flange and key means engaging said spool, and a generally circular toothed gear wheel;

providing a pawl having at least one tooth thereon sliding along a longitudinally extending path parallel to a tangent to said gear wheel, spaced therefrom a distance such that at one position of said pawl with respect to said gear wheel, said teeth on said pawl engage said gear wheel, said pawl being biased by biasing means in one direction along said path, and being permitted to move along said path a distance sufficient to disengage said teeth on said pawl from said gear wheel in the opposite direction only, said path being defined by a recess in which said pawl is permitted to slide;

whereby unwinding of said tape from said spool is at all times opposed by a tension imparted by said biasing means, and said pawl is confined to said recess by said flange.

8. The method according to claim 7 wherein said biasing means is a spring.

9. The method according to claim 7 wherein said capstan further comprises a shaft, and wherein said key means on said capstan comprises a keyway extending helically around said shaft.

* * * * *